US006328631B1

(12) United States Patent
Fukano et al.

(10) Patent No.: US 6,328,631 B1
(45) Date of Patent: Dec. 11, 2001

(54) METHOD AND APPARATUS FOR SURFACE PROCESSING USING ICE SLURRY

(75) Inventors: Shuji Fukano; Hiromichi Fukumoto; Hisashi Kitagawa; Akira Haishima, all of Tokyo; Naokatsu Kojima, Shizuoka, all of (JP)

(73) Assignees: Mayekawa Mfg. Co., Ltd., Tokyo; Fuji Seiki Machine Works, Ltd., Shizuoka, both of (JP)

( * ) Notice: Subject to any disclaimer, the term of this patent is extended or adjusted under 35 U.S.C. 154(b) by 0 days.

(21) Appl. No.: 09/557,777

(22) Filed: Apr. 25, 2000

(30) Foreign Application Priority Data

Apr. 28, 1999 (JP) ..... 11-122319
Jul. 15, 1999 (JP) ..... 11-201284

(51) Int. Cl.[7] ..... B24B 1/00

(52) U.S. Cl. ..... 451/39; 451/53; 451/60; 451/99; 222/146.6

(58) Field of Search ..... 451/38, 39, 53, 451/60, 99, 446; 222/146.6; 241/DIG. 17, DIG. 37

(56) References Cited

U.S. PATENT DOCUMENTS 5,009,240 * 4/1991 Levi ..... 134/7
5,283,989 * 2/1994 Hisasue et al. ..... 451/75
5,785,581 * 7/1998 Settles ..... 451/99
5,913,711 * 6/1999 Visaiouk ..... 451/39
6,001,000 * 12/1999 Visaisouk et al. ..... 451/39

* cited by examiner

*Primary Examiner*—Joseph J. Hail, III
*Assistant Examiner*—David B. Thomas
(74) *Attorney, Agent, or Firm*—Crowell & Moring LLP

(57) ABSTRACT

Ice grains of uniform grain size are produced through the change of state of supercooled water and the ice grains are mixed into cold water for obtaining an ice slurry of proper concentration. The ice slurry is injected from an injection means to the surface of a workpiece. As the ice grains are fine and uniform and they are injected with water in the state of ice slurry of stable concentration, a surface processing of a soft workpiece susceptible to damage can be performed without causing damage, and the cleaning of the processed surface is performed concurrently with the surface processing, eliminating the necessity of after cleaning. The apparatus is compact and the initial cost is low. The energy needed for preparing the ice slurry is small.

13 Claims, 6 Drawing Sheets

METHOD AND APPARATUS FOR SURFACE PROCESSING USING ICE SLURRY

BACKGROUND OF THE INVENTION

1. Field of the Invention

The present invention relates to a liquid honing or liquid blasting apparatus using ice slurry (hereinafter referred to as surface processing apparatus using ice slurry) which performs such machining as fine processing or polishing of surface by blowing slurried ice grains onto the surface with high pressurized fluid. More specifically, it relates to a surface processing apparatus in which the ice slurry is introduced to a surface processing section and the slurry is spouted to a workpiece by the medium of an injection means in the surface processing section to perform the honing or blasting.

2. Description of the Related Art

Liquid blast or liquid honing (hereinafter both of these are referred to as liquid honing) of blowing onto the surface of a workpiece a suspension in which abrasive grains or granular substances are suspended, accelerating the suspension to high velocity by utilizing fluid pressure, is well known in the art. The honing is used extensively for removing burrs after machining, removing burrs of molded parts, fine processing, surface polishing, etc., using as injected substances polishing abrasive grains, glass beads, vegetable particles, and synthetic resin particles.

However, by the prior art mentioned above, the injected substance may remain on the surface of the workpiece, and changes in dimensions and damage to the processed surface may occur. For this reason, a large amount of cost and time are spent in the after-treatment, particularly in removing residue.

Several ice-blasting processes in which ice grains or dry ice grains are injected with a high pressure gas, are disclosed.

For example, there are disclosed an art of injecting only ice grains to the surface of a workpiece by utilizing an ejector in the Japanese Unexamined Patent Publication No. Sho 58-02674; an art of injecting frozen particles frozen in a low temperature atmosphere produced by the evaporated gas of a refrigerant, in the Japanese Patent Publication No. Hei 7-57471; and an art of ice-blast using dry ice grains, in the WO86/04536.

However, all of these arts are constituted so as to inject only ice grains or dry ice grains with a gas stream, and not accompanied with cleaning function. For this reason, there remain problems such as re-adhesion of scraped-off matter once scraped off the workpiece; accumulation and agglomeration of ice on the surface of the workpiece; and pipe blockage with the ice or dry ice grains, the substances to be injected, in the process of the transfer to the injection portion, due to which the stable operation of the injection nozzle is not ensured.

An art of liquid honing (blast) using ice slurry to solve the problems mentioned above, is disclosed in the Japanese Unexamined Patent Publication No. Hei 8-309660.

According to the disclosure, although ice is used as substance to be injected for the sake of not causing damage on the processed surface of the workpiece the same as is used in the prior art of ice-blast, the ice is mixed with water to make ice slurry. The liquid honing is performed using the ice slurry in order to exclude the necessity of cleaning after the honing.

This prior art is shown in FIG. 6. As shown in the figure, lumps of ice 50 are crushed to ice grains in an ice grain manufacturing device 57, water 52 is cooled in a liquid storage tank 53, the ice grains formed in the ice grain manufacturing device 57 and the water cooled in the liquid storage tank 53 are supplied to the stirring mixer tank 55 to obtain an ice slurry 51 by stirring and mixing. The ice slurry 51 is supplied to a high pressure injection nozzle 22 through a pump 54, and injected therefrom with high pressure gas introduced from high pressure gas introducing pipe 58, to perform blast.

Thus, in this prior art, proper amount of ice grains of proper grain size are prepared in the ice grain manufacturing device 57 by crushing the lumps of ice 50 supplied by an ice lump supplying device not shown in the drawing; cooled water 52 of proper temperature is prepared in the liquid storage tank 53 by cooling the water supplied from a new water supplying part 17 by a unit cooler 56; the prepared ice grains and cooled water 52 are supplied by proper amount to the stirring mixer tank 55 from the ice grains manufacturing device 57 and the liquid storage tank 53 respectively; thereby an ice slurry of proper concentration is formed by stirring and mixing; and the ice slurry is transferred by the medium of the pump 54 to the high pressure injection nozzle 22 to be injected therefrom to perform surface processing.

Injection discharge water 28 collected to a discharge liquid collecting tank 20*a* provided in the liquid honing section 21, is returned to the liquid storage tank 53 through a drain pump 22*b* and a filter 22*c*. The liquid storage tank 53 is also replenished with new water supplied from the new water supplying part 17 to keep a predetermined level.

However, there remain also in this prior art the following problems: an ice grain manufacturing section for crushing lumps of ice so as to reduce them to ice grains of proper grain size is needed along with an ice lump feeder, which results in the high cost of equipment; it is difficult to obtain ice grains of uniform diameter in the ice grain manufacturing section in which ice lumps are crushed mechanically, and with nonuniform grain size the blast performance is unstable; a stirring mixer tank is needed to obtain ice grains of proper concentration by mixing the crushed ice grains with the water cooled by a cooling unit; and even with the mixer tank, the concentration of the ice slurry is apt to be unstable, as the ice grains and the water cooled by the chiller are supplied separately to be mixed.

SUMMARY OF THE INVENTION

The present invention was made in light of the problems mentioned above. An object is to provide a compact and low cost process and apparatus for surface processing using ice slurry, without providing a separate stirring mixer tank and with stable blast performance, by using ice slurry of stable concentration containing ice grains of uniform grain size and formed by constantly discharging the ice grains, for performing a processing similar to liquid honing or liquid blast by injecting to a workpiece the ice slurry formed by mixing the ice grains and water.

Another object of the present invention is to provide a process and apparatus for surface processing using ice slurry, which can perform surface processing without damage to the surface, even in the case of a soft workpiece susceptible to damage.

To attain the above described objects, a method according to the present invention is the method for surface processing using ice slurry for performing a processing similar to liquid honing or liquid blast by injecting to a workpiece an ice slurry formed by mixing ice grains with water, characterized in that the ice grains are obtained through changing the state of supercooled water cooled to a temperature below freezing point by a supercooled water relief means; and an ice slurry obtained by mixing the ice grains with cooled water in a predetermined ratio is injected to a workpiece.

It is preferable to set the temperature of the supercooled water to about −2~0° C. for obtaining uniform ice grains of diameter of 0.1 mm~0.2 mm, preferably 0.1 mm~1 mm.

According to the invention, uniform ice grains are formed through changing the state of the supercooled water by giving an impact to it, not by mechanical crushing. So, by using the ice slurry of stable concentration containing ice grains of uniform diameter and formed by constantly discharging the ice grains, stable performance of blast is secured without a separate stirring mixer tank. Thus, a compact, low-cost apparatus for surface processing using ice slurry can be obtained.

According to the present invention, an apparatus for surface processing using ice slurry for performing a processing similar to liquid honing or liquid blast by injecting an ice slurry formed by mixing ice grains and water to a workpiece by the medium of an injection means characterized in that an apparatus for producing super-cooled water below freezing temperature and a supercooled water relief means for obtaining the ice grains through changing the state of supercooled water, are provided; and the supercooled water relief means is positioned above an ice slurry storage tank for storing the ice slurry formed by mixing the ice grains with cooled water.

The supercooled water relief means may be an impact plate for producing ice grains through the impinging of the falling supercooled water against the plate, preferably an inclined plate. The supercooled water relief means may also be an in-water relieving section where the supercooled water is changed to ice grains through the collision with solid grains or bubbles.

By forming the supercooled water relief means in the shape of an inclined plate made of heat insulating or low friction material, the ice grains produced on the plate smoothly slide down to the ice slurry storage tank without adhering to the inclined plate.

Further, an apparatus according to the present invention is characterized in that an adjusting means of the mixture ratio (concentration of the ice slurry) of the ice grains and cooled water in the ice slurry injected to the workpiece is positioned on a slurry transfer passage between the ice slurry storage tank and the injection means, and the cooled water is the water of near freezing temperature introduced from the bottom portion of the ice slurry storage tank.

According to the invention, the concentration of the ice slurry for surface processing is accurately adjusted.

An independent cooled water storage tank is not necessary. The ice grains do not thaw, as the cooled water for the adjustment is the water of near freezing temperature introduced from the bottom portion of the ice slurry storage tank.

Still further, provision of a monitor means for monitoring the concentration of the ice slurry injected to the workpiece on the circulation passage to the ice slurry storage tank, enables the stabilization of the concentration of the slurry, eliminating the need for the adjusting means.

Still further, according to the present invention, an apparatus for surface processing using ice slurry performing a processing of surface by introducing the ice slurry produced in an ice slurry production section to a surface processing section through an ice slurry transfer passage and injecting the ice slurry to a workpiece by an injection means driven by a high pressure fluid, is characterized in that the slurry production section consists of a supercooled water production section for forming ice grains through relieving the supercooled water, an ice slurry storage tank for forming the ice slurry by stirring/mixing the ice grains received therein with the stored cold water, and an ice slurry concentration adjusting section provided on the transfer passage for introducing the ice slurry to the injection means at the upstream part.

According to the invention, along with the effect of the invention described before, the ice grain size and the amount of the ice grain supply are stable, as the ice grains are obtained through changing the state of the supercooled water on the ice grain crystallization plate in the atmosphere or in the in-water relief vessel.

The concentration of the ice slurry can be controlled to a stable value by continuously controlling the amount of the cooled water in the ice slurry storage tank to a predetermined one. By controlling the temperature and flow rate of the supercooled water in the supercooled water production section, the ice slurry for blast, capable of being controlled of ice grain size and discharge rate and being stable in blast performance, is obtainable.

It is preferable that the supercooled water production section includes a cooler for producing the supercooled water from cold water and a supercooled water relief means for relieving the supercooled state thereof, and a cold water temperature adjusting part provided at the upstream of the cooler.

The supercooled water relief means may be an impact plate for producing ice grains through the impinging of the falling supercooled water against the plate, preferably an inclined plate. The supercooled water relief means may also be an In-water relieving section where the supercooled water is changed to ice grains by the collision with solid grains or bubbles, as mentioned before.

According to the constitution mentioned above, the cold water stored in the ice slurry storage tank is introduced to the brine cooler of the supercooled water production section, and preferably supercooled to about −1~−2° C. without freezing. The supercooled water is introduced to upper part of the ice slurry storage tank, and relieved from supercooled state through the impact of collision against the ice crystallization plate or the change of state in the in-water relief vessel, to be congeal to ice grains. The ice grains fall down into the ice slurry storage tank, in which the fallen ice grains mix with the cold water to form the ice slurry.

The adjusting section of the cold water temperature is provided on the supply passage of the cold water to the brine cooler. The prevention of the cold water from freezing in the brine cooler is effected by the adjustment of the cold water temperature.

By use of the brine cooler, temperature adjustment in accordance with the variation of load is possible and the size and discharge rate of ice grains can be controlled. A direct expansion type cooler may be used instead of the brine cooler.

The concentration adjusting section is preferably constituted so that the concentration is adjusted by supplying a proper amount of the cold water from the ice slurry storage tank to high concentrated ice slurry drawn out from the ice slurry tank at the upstream part of the transfer passage, as mentioned before.

According to the constitution described above, the cold water of near about constant 0° C. in the ice slurry storage tank, is supplied, in accordance with the need for adjusting the ice concentration, at the upstream of the process of transferring to the injection nozzle the ice slurry formed by stirring in the ice slurry storage tank. The ice slurry in the storage tank is highly concentrated and more stable in comparison with the prior art in which water of over 0° C. cooled by a chiller and ice grains are supplied separately to be agitated.

The cold water of virtually 0° C. is added to the highly concentrated ice slurry when reducing the concentration, and more stable ice concentration adjustment is possible.

The ice slurry storage tank is provided with a circulation passage for returning the discharge water from the injection means of the surface processing section to be used as cold water.

With this constitution, the discharged ice slurry transferred through the transfer passage and injected as injection material from the injection means of the honing section, is collected in a discharge water collecting tank; and the top liquid exclusive of precipitate is returned to the ice slurry storage tank by way of a filter, to be reused.

The transfer passage is of a double-piped one connecting the ice slurry storage tank with the injection means; the ice slurry being transferred in the inner pipe to the injection means by the fall (static head) or pressure feed, and the discharge water from the injection means being transferred in the outer pipe outside the inner pipe in the reverse direction.

According to the invention, as the outside of the ice slurry passage is surrounded by the discharge water of near 0° C. from the injection means, the transfer of the slurry of designated concentration is possible without thawing of the ice grains in the slurry.

DETAILED DESCRIPTION OF THE PREFERRED EMBODIMENTS

Preferred embodiments of the present invention will now be detailed with reference to the accompanying drawings. It is intended, however, that unless particularly specified, dimensions, materials, relative positions and so forth of the constituent parts described in the embodiments shall be interpreted as illustrative only not limitative of the scope of the present invention.

Figure 1:
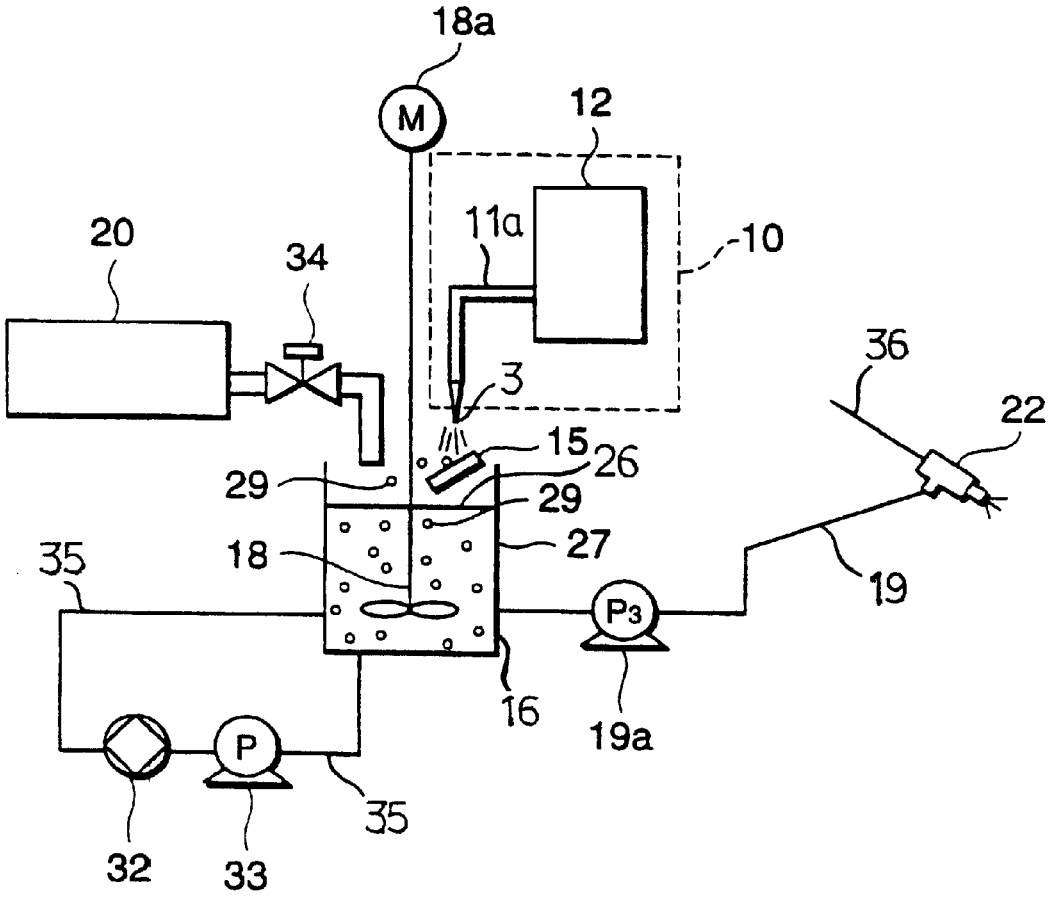
FIG. 1 is a diagrammatic sketch showing the outline of the constitution of the first embodiment of an apparatus for surface processing using ice slurry according to the present invention.

Referring to FIG. 1, an embodiment of a liquid honing apparatus using ice slurry will be explained. In FIG. 1, reference numeral 10 denotes a supercooled water production apparatus having a supercooling division 12 (air cooled condensing unit) for cooling water to a supercooled state. The supercooled water 3 in the neighborhood of −2° C. produced in the supercooling division 12 falls from a guide pipe 11*a* and impinges against an ice grain crystallization plate 15, thereby ice grains 29 of 0.1 mm~2 mm, preferably 0.1 mm~1 mm are crystallized.

The ice grain crystallization plate 15 (ice-making plate) is an inclined plate made of heat insulating plate coated with fluororesin on the surface and positioned above a slurry storage tank 16. The ice grains 29 crystallized on the crystallization plate 15 are introduced to the slurry storage tank 16.

By the way, supercooled water is the water cooled to below freezing point (about −1~−2° C.) and still not frozen. It keeps liquid state maintaining metastable phase without the change of state, but has the property of freezing instantly when given some impact.

A cooled water supply apparatus 20 is provided above the ice slurry storage tank 16 positioned right under the ice grain crystallization plate (ice-making plate). The cooled water supply apparatus 20 supplies cooled water 27 controlled to near 0° C. to the slurry storage tank 16, and the supply amount of cooled water 27 is adjusted by a magnetic valve 34, which is on-off controlled based on the signal from a monitor 32.

An agitator blade 18 driven by a motor 18*a* is provided inside the ice slurry storage tank 16. The agitator blade 18 agitates the ice grains 29 crystallized by the ice grain crystallization plate 15 and the cooled water supplied from the cooled water supply apparatus 20 through the magnetic valve 34 to produce ice slurry of uniform concentration.

The slurry monitor 32 is connected by a circulation passage 35 to the ice slurry storage tank 16 by way of a slurry pump 33, and detects continuously the concentration of the slurry. The slurry concentration is adjusted by adjusting the amount of the cooled water flowing into the ice slurry storage tank 16 through proper on-off operation of the magnetic valve 34 based on the detected result of the slurry monitor 32.

Thus the designated concentration of ice slurry needed for the blast is maintained. The ice slurry 26 is sent pressurized by a slurry pump 19*a* to an injection nozzle (blast gun) 22 from the ice slurry storage tank 16 through an ice slurry transfer passage 19. The ice slurry is injected from the injection nozzle 22 by a compressed gas supplied through a compressed gas supply pipe 36. Air is generally used for use as compressed gas.

It is suitable that the ice slurry is injected from the injection nozzle 22 with high velocity by the pressure of the slurry pump 19*a* without using the pressured gas (air).

Thus, according to the embodiment, the supercooled water cooled to below freezing point (about −2° C. in the embodiment) at the supercooling division 12 in the supercooled water production apparatus 10, falls down to impinge against the crystallization plate 15; the supercooled water is partly frozen instantly to the ice grains 29 by the impact and becomes a mixture of the ice grains 29 and water; and the mixture containing the ice grains 29 is supplied to the ice slurry storage tank 16 in succession.

The mixture has a stable IPF (Ice Packing Factor) of the neighborhood of 60% and ice grain diameters are extremely uniform as they are 0.1 mm~2 mm, preferably 0.1 mm~1 mm. The mixture containing the ice grains 29 supplied to the ice slurry storage tank 16 by utilizing the inclined surface of the crystallization plate 15, is mixed with the temperature controlled cooled water 27 supplied from the cooled water supply apparatus 20; the supply of the cooled water 27 is controlled so as to be able to obtain the predetermined concentration of slurry by on-off operation of the magnetic valve 34 based on the signal from the monitor 32; and the ice slurry 26 reduced to the predetermined concentration through agitation by the agitator blade 18, is stored in the slurry storage tank 16.

The slurry 26 is transferred to the injection nozzle (blast gun) 22 through the transfer passage 19, whereby the slurry 26 is accelerated by the compressed gas supplied from the compressed gas supply pipe 36 to be injected from the blast gun 22 for processing the surface of the workpiece.

The ice grains in the ice slurry obtained according to the embodiment, are of the grain diameter of 0.1 mm~2 mm, preferably 0.1 mm~1 mm, so they are superior in uniformity. So even in the case where damage might be caused to the surface of the workpiece by the blast by a liquid honing apparatus using conventional ice slurry, the use of the ice slurry obtained according to the embodiment eliminates the problem and improves the quality of blast work.

Thus, an apparatus according to the embodiment is very useful when processing precision parts for removing burrs, cleaning, etc. Further, as the ice grains is produced directly from the supercooled water not by slicing ice blocks with an ice-slicer, energy efficiency for making ice is outstandingly high, so the invention is remarkably superior also from the viewpoint of energy-saving.

Figure 2:
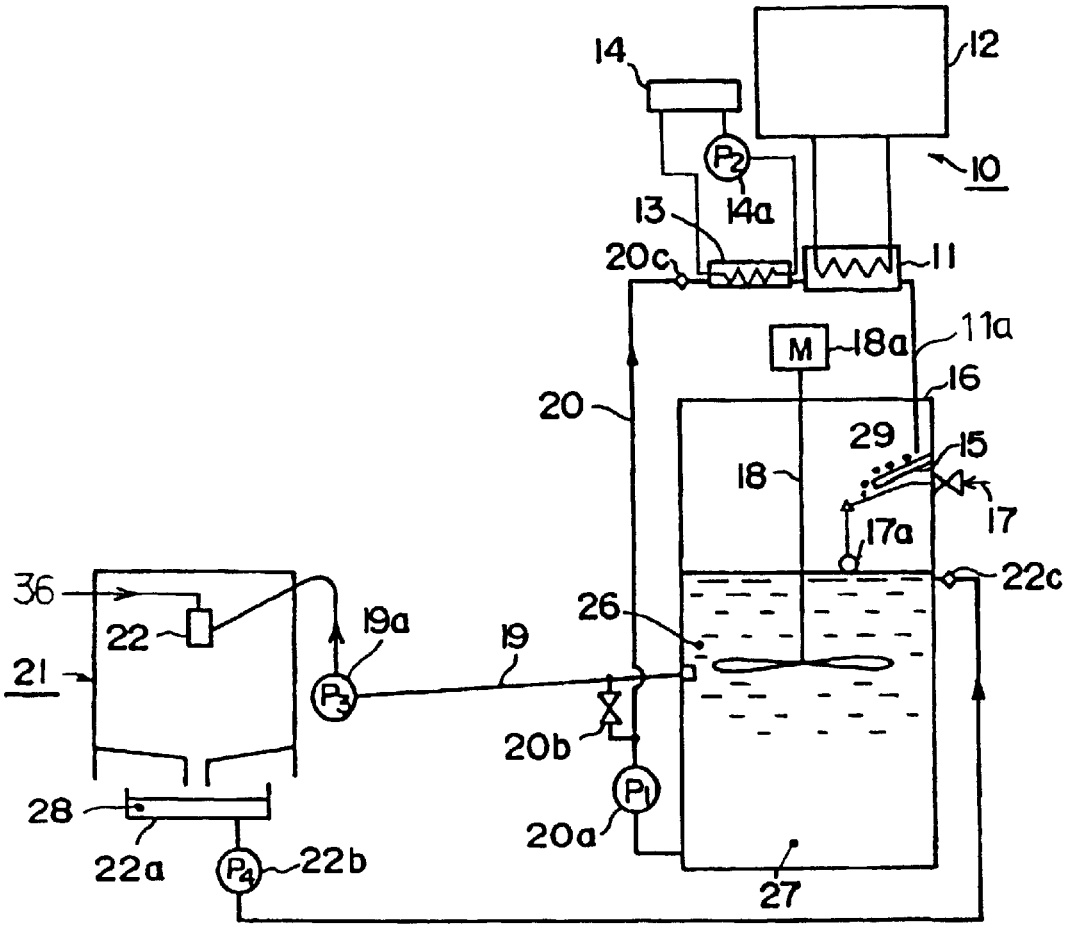
FIG. 2 is a diagrammatic sketch showing the details of the constitution of the second embodiment of an apparatus for surface processing using ice slurry according to the present invention.
Figure 3:
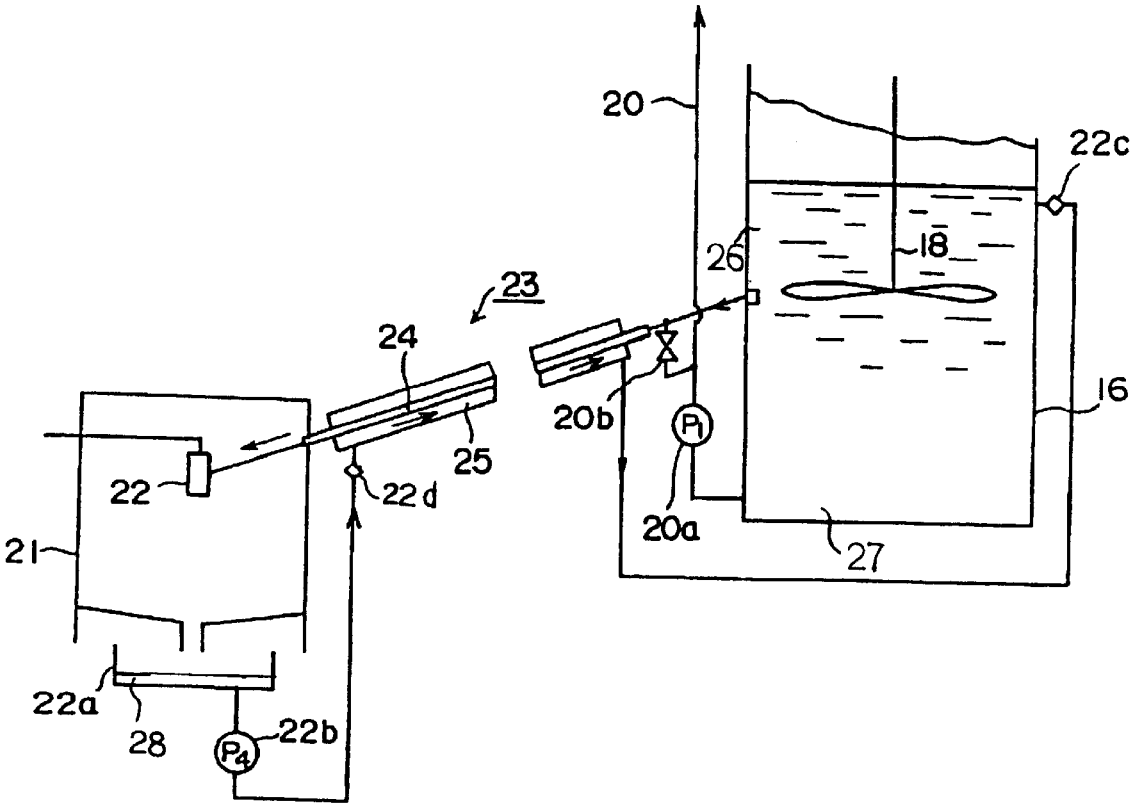
FIG. 3 is a diagrammatic sketch showing the transfer passage of ice slurry applied to the apparatus for surface processing using ice slurry of FIG. 2.

FIG. 2 is a diagrammatic sketch showing another embodiment of an apparatus for surface processing using ice slurry according to the present invention, and FIG. 3 shows a preferred embodiment of the transfer passage of FIG. 2. Same reference numerals are used for parts having the same function as the constituent parts used in FIG. 1.

As can be seen in FIG. 2, an apparatus for surface processing using ice slurry according to the present invention, includes an ice grains crystallization plate 15; is composed of a supercooled water production apparatus 10 for forming the ice grains used as substance to be injected in honing; a slurry storage tank 16 for forming ice slurry from the ice grains formed in the supercooled water production apparatus 10 and the cooled water stored in the slurry storage tank 16; a cooled water re-supply passage 20 for re-supplying the cooled water stored in the slurry storage tank 16 to the supercooled water production apparatus 10; a transfer passage 19 for supplying the ice slurry from the ice slurry storage tank 16 to an injection nozzle 22 for honing; and a honing section (surface processing section) 21 whereby the injection nozzle 22 is actuated by a high pressure gas.

Main constituents of the supercooled water production apparatus 10 are a cooler 11 for producing supercooled water from the cold water 27 of the neighborhood of about 0° C. supplied from the ice slurry storage tank 16 through the cold water re-supply passage 20, and an air-cooled condensing unit for supplying cold heat to the cooler 11.

The cooler 11 is composed to be a brine cooler, capable of being operated for heat storage. It responds to the temperature and flow rate of the supercooled water and controls the temperature and flow rate of the brine to obtain supercooled water of metastable phase of about −1.5° C.

The supercooled water falls down from a guide pipe 11*a* provided above the ice grain crystallization plate 15 provided inclined in the space right above the ice slurry storage tank 16 to impinge against the plate 15.

The supercooled water is relieved of the metastable phase by the impact of the impinging, freezes to form the ice grains 29, and falls down into the ice slurry storage tank 16.

The air cooled condenser 12 is a refrigerating machine for cooling the cooling medium which uses a secondary refrigerant as brine for the cooler 11; and comprises a compressor, an air-cooled condenser, a receiver tank, an expansion valve, brine cooler, etc., which are operated with primary refrigerant.

It is suitable to adopt a direct expansion type cooling in which the primary refrigerant of the refrigerating machine is introduced directly to the cooler 11, without using the brine as secondary refrigerant.

As to the condensing unit 12, the system can be operated with a water-cooled condensing unit instead of an air-cooled condensing unit. Especially, in the case of upsizing, the water-cooled condensing unit is suitable.

A pre-heater 13 is provided on the cooled water re-supply passage 20*d* in the upstream of the cooler 11.

The temperature of the cold water supplied through the re-supply passage 20 is adjusted in the pre-heater 13 by the hot water supplied from a water tank 14 through a pump 14*a* and a filter 20*c*, for preventing the cold water from freezing in the cooler 11.

The heat source for the pre-heater 13 is hot water in the embodiment of FIG. 2, however, a study indicates that the hot gas (high temperature gas) from the condensing unit 12 can be used as the heat source, so either the hot water or high temperature gas is suitable to be used as heat source for the pre-heater 13.

In the ice slurry storage tank 16, the ice grains 29 introduced from the supercooled water production apparatus 10 including the ice grains crystallization plate 15, and the discharge water 28 in the honing section 21 returned through a pump 22*b* and filter 22*c* to the slurry storage tank 16, are agitated by the agitator blade 18 driven by a motor 18*a*, to form stable ice slurry 26 of high concentration. The discharge water 28 is returned from the honing section 21 pressurized by the pump 22*b* and via filter 22*c* to the storage tank 16 from an opening located near the surface of the cooled water in the storage tank 16. The returned water effects a revolving movement of the cluster of the ice grains 29 to promote the effect of the agitation by the agitator blade 18 via motor 18*a*.

Supply of new water to the ice slurry storage tank 16 is possible from a new water supply part 17 at any time when necessary. Water level in the tank 16 is kept constant by ball tap 17*a*.

The lower part of the ice slurry tank 16 is connected with the cooled water re-supply passage 20*d* through which the cooled water 27 of about constant 0° C. is introduced to the pre-heater 13 and cooler 11 through the pump 20*a* and filter 20*c*. By this composition, stable ice grains can be obtained.

A transfer passage 19 is connected to the side wall of the ice slurry storage tank 16 at the high concentration stable zone of the ice slurry so that the stable ice slurry of maximum concentration is drawn out by the pump 19*a* to be supplied to the injection nozzle 22 of the honing section 21. By this composition, the ice slurry of high concentration is injected with high speed to the surface of the workpiece, by the medium of a high pressure 36 such as compressed air supplied through a compressed gas supply pipe; and required fine processing and cleaning are possible.

The ice slurry loses its latent cold heat, becomes low temperature discharge water 28 of about 0° C. and is stored in a discharge water tank 22*a*. The top fluid in the tank 22*a* is returned as return water to the ice slurry storage tank 16 through the pump 22*b* and the filter 22*d*.

An opening for cold water intake 20*b* is provided at the upstream side of the slurry transfer passage 19, and the cold water of about 0° C. taken-in by proper volume is added to the drawn-out ice slurry of high concentration to reduce it to a proper, stable concentration. Thus the blockage of the pipe in the transfer process is prevented.

It is preferable to provide a wire net of proper mesh at the opening for taking in the ice slurry to the transfer passage 19 from the ice slurry storage tank 16, in order to uniformize the grain size distribution of the ice grain transferred to the injection nozzle 22.

FIG. 3 shows a preferable embodiment of the ice slurry transfer passage of FIG. 2.

In the embodiment, a transfer passage 23 is of double-piped construction, composed of an inner pipe 24 and an outer pipe 25, and inclined downward toward the injection nozzle 22 of the honing section 21.

The ice slurry 26 flows down in the inner pipe 24 by the static head; and the discharge water 28 stored in the discharge water tank 22*a* of the liquid honing section 21 is returned pressurized by the pump 22*b* through the filter 22*c* to the ice slurry storage tank 16 in the passage between the outer pipe 25 and the inner pipe 24.

As the discharge water 28 is low temperature water having lost its latent cold heat through the honing work, the temperature of the outer surface of the inner pipe 24 is kept at about 0° C. Accordingly, the blockage of the inner pipe 24 due to ice grains is prevented automatically, and the stable state of the ice slurry in the inner pipe 24 is maintained.

As the apparatus for surface processing using ice slurry is constituted as described above, its operation is preferably started from the pre-cooling operation, proceeded to the ice-making operation, and after that shifted to the liquid blast (liquid honing) operation.

In the pre-cooling operation, a circulation from the ice slurry storage tank 16 through the cooler 11 to the ice slurry storage tank 16, is performed to pre-cool the water to be stored in the ice slurry storage tank 16.

Then, operation is shifted to the ice-making operation, whereby a circulation from the ice slurry tank 16 through the pre-heater 13, the cooler 11, the ice grains crystallization plate 15 to the ice slurry storage tank 16, is performed. In this process, the ice grains 29 are formed, and the rotating layer of the ice slurry 26 having stable concentration is formed in the ice slurry storage tank 16.

Then, operation is shifted to the blast operation, whereby the ice-making operation and blast operation are performed concurrently as follows:

In the ice-making operation, ice-making is performed by the circulation from the ice slurry tank 16 through the pre-heater 13, the cooler 11, the ice grains crystallization plate 15, to the ice slurry storage tank 16; in the blast operation using the slurry 26 from the ice slurry storage tank 16, the blast process and the return process of cold water are performed in the circulation from the ice grains storage tank 16 through the honing section 21, the discharge water tank 22*a*, to the grains storage tank 16; and new water is supplied to the ice slurry storage tank 16 as needed based on the level sensed by the ball tap 17, a level sensor.

Therefore, according to the embodiment, the cleaning of the workpiece after processing is performed concurrently with the surface processing. As the ice grains in the ice slurry are produced by the relief of the supercooled state and the grain size and the amount of the grains produced are controlled by using the brine cooler, a stable ice slurry can be obtained. Stable blast performance by use of the stable ice slurry is attained, and by eliminating the need for after-cleaning, the initial cost is kept low.

The supercooled state relief means is not limited to that of the embodiments described above, in which ice grains are produced by the impingement of falling supercooled water against a plate: adoption of an in-water relief means in which ice grains are produced by the collision of solid particles or bubbles to the supercooled water, is possible.

Figure 4:
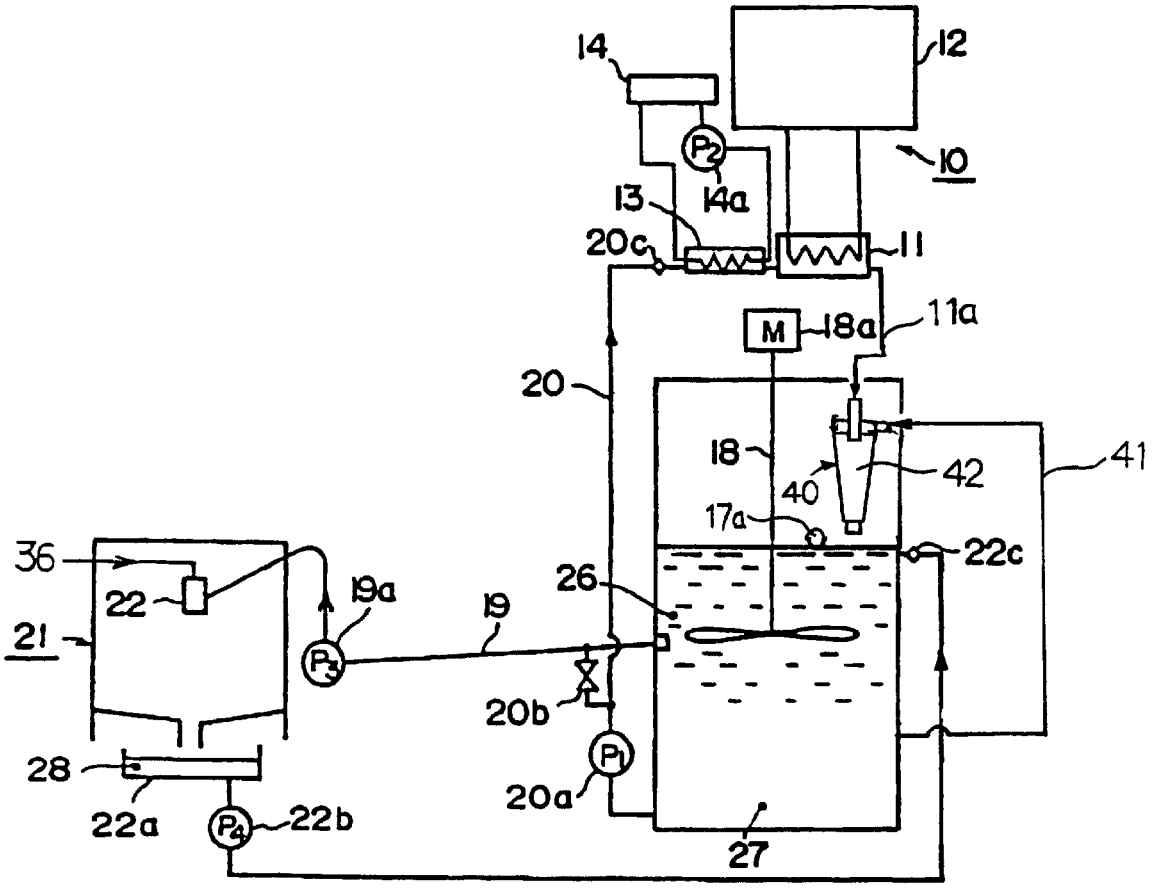
FIG. 4 is a diagrammatic sketch showing the details of the constitution of the third embodiment of an apparatus for surface processing using ice slurry according to the present invention.

FIG. 4 shows the third embodiment of an apparatus for surface processing using ice slurry according to the present invention, which uses an in-water relief means.

Figure 5A:
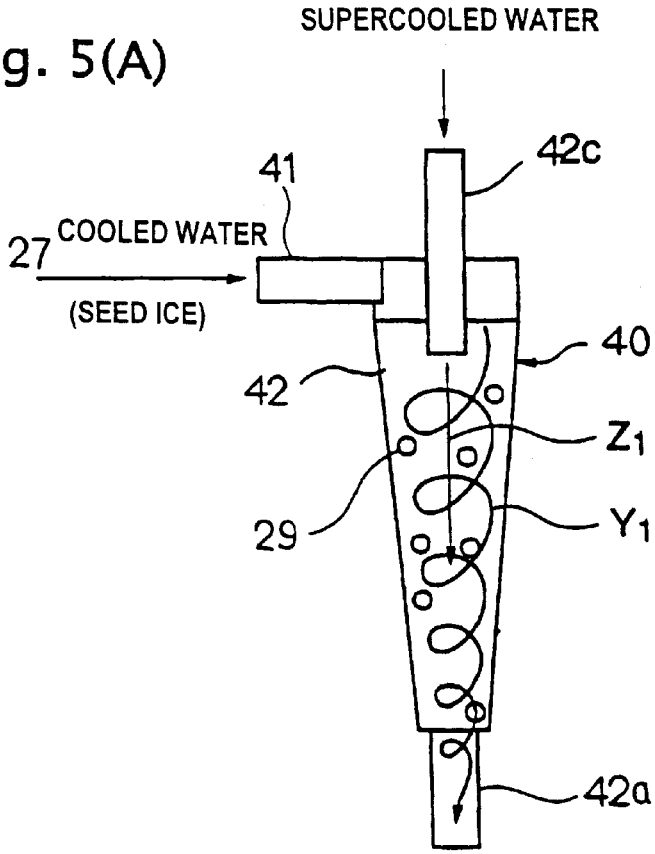
FIG. 5 is a diagrammatic sketch showing the in-water relief section for the relief of supercooled water applied to the apparatus for surface processing using ice slurry of FIG. 2.
Figure 5B:
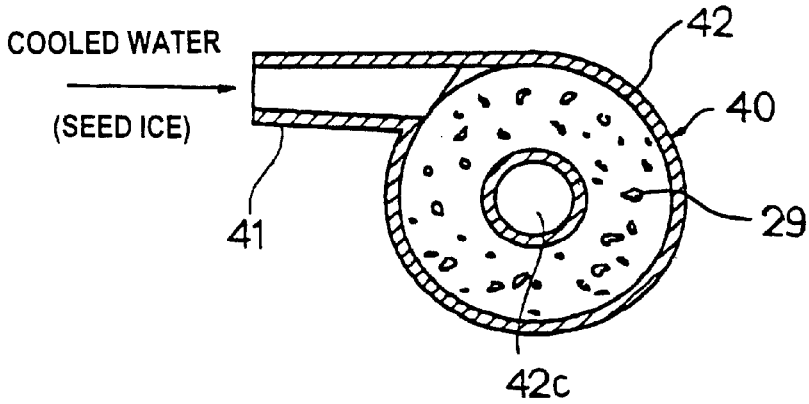
Figure 6:
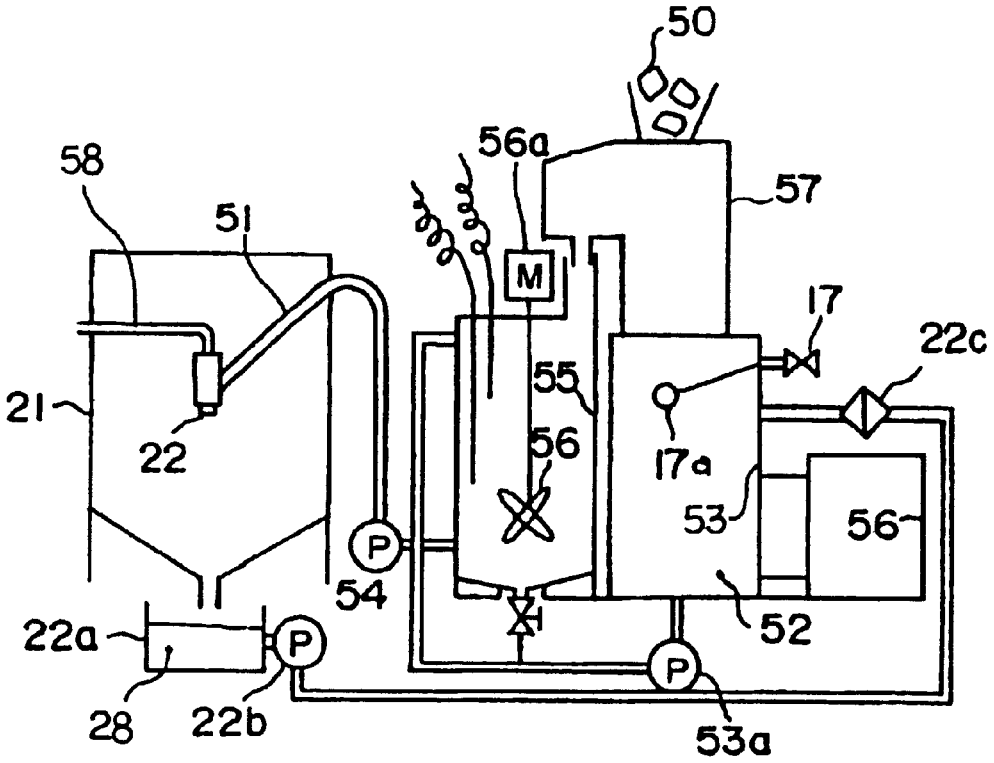
FIG. 6 is a diagrammatic sketch showing an apparatus for surface processing using ice slurry of a prior art.

FIG. 5 shows the in-water relief means for relieving supercooled state, applied to the apparatus for surface processing using ice slurry shown in FIG. 4.

In an in-water relief means 40, the supercooled water supplied from a cooler 11, is introduced to a spiral stream generating vessel 42 (in-water relief portion) of funnel form through a vertical passage 42*c*; the cooled water 27 of the neighborhood of 0° C. supplied from an ice slurry storage tank 16, is introduced to the vessel 42 through a passage 41 provided at the upper part of the vessel 42 in tangential direction to form a spiral stream Y1; and fine seed ice particles are introduced from the ice slurry storage tank 16 together with the cooled water which forms the spiral stream Y1.

By introducing the seed ice particles, the change of state of the supercooled water (in-water relief) occurs and ice grains are produced.

In the vessel 42, the seed ice particles are mixed and agitated with the supercooled water by the revolving stream Y1 together with the vertical stream Z1 of the supercooled water to effect the relief of supercooled state, the relief of supercooled state propagates gradually, the IPF (Ice Packing Factor) becomes high at the outlet 42*a* positioned right above the ice slurry storage tank 16, and ice grains mixed in water is exhausted into the ice slurry storage tank 16.

The seed ice particles act only as conducive to in-water relief, and it is preferable not to introduce them after the relief has started.

When the vessel 42 is filled with the supercooled water, the relief of supercooled state propagates toward upstream up to the cooler 11, in spite of the flowing supercooled water. To prevent this phenomenon, the revolving stream is formed as a secondary stream, and the velocity near the wall surface of the vessel 42 is increased. As the temperature of the revolving stream is about 0° C. the propagation of the relief up to the cooler 11 can be easily prevented.

As the production of the ice slurry is performed by the relief of the supercooled water also in the embodiment, the grain size and the rate of production of the ice grains can be controlled by the use of the brine cooler to obtain the ice slurry of required concentration, the stable blast performance is achieved by use of the stable ice slurry, the cleaning of the workpiece is performed concurrently with the blast, and the initial cost is kept low.

What is claimed is:

1. A method for surface processing using ice slurry for performing a processing similar to liquid honing or liquid blast by injecting to a workpiece an ice slurry formed by mixing ice grains with water, wherein the ice grains are obtained through changing the state of supercooled water cooled to a temperature below freezing point by a supercooled water relief means; and an ice slurry obtained by mixing the ice grains with cooled water in a predetermined ratio is injected to a workpiece.

2. A method for surface processing using ice slurry according to claim 1, wherein the supercooled water relief means is an impact plate for producing the ice grains by the impinging of falling supercooled water against the plate or an in-water relief means in which the ice grains are produced by the collision between solid particles or bubbles and the supercooled water.

3. An apparatus for surface processing using ice slurry for performing a processing similar to liquid honing or liquid blast by injecting an ice slurry formed by mixing ice grains and water to a workpiece by the medium of an injection means, wherein an apparatus for producing supercooled water below freezing temperature and a supercooled water relief means for obtaining ice grains through changing the state of supercooled water, are provided; and the supercooled water relief means is positioned above an ice slurry storage tank for storing the ice slurry formed by mixing the ice grains with cooled water.

4. An apparatus for surface processing using ice slurry according to claim 3, wherein the supercooled water relief means is an impact plate for producing the ice grains through the impinging of the falling supercooled water against the plate.

5. An apparatus for surface processing using ice slurry according to claim 3, wherein the supercooled water relief means is an in-water relief means for producing the ice grains by the collision between solid particles or bubbles and the supercooled water.

6. An apparatus for surface processing using ice slurry according to claim 3, wherein an adjusting means of the mixture ratio (concentration of ice slurry) of the ice grains with cooled water of the ice slurry injected to the workpiece, is positioned on a slurry transfer passage between the ice slurry storage tank and the injection means; and the cooled water is the water of near freezing temperature introduced from the bottom portion of the ice slurry storage tank.

7. An apparatus for surface processing using ice slurry according to claim 3, wherein a monitor means of the concentration of the ice slurry to be injected to the workpiece is provided on a passage for circulating the ice slurry to the ice slurry storage tank.

8. An apparatus for surface processing using ice slurry for performing a processing of surface by introducing the ice slurry produced in an ice slurry production section to a surface processing section through an ice slurry transfer passage and injecting the ice slurry to a workpiece by an injection means driven by a high pressure fluid, wherein the slurry production section consists of a supercooled water production section for forming the ice grains through relieving the supercooled water, an ice slurry storage tank for forming an ice slurry by stirring/mixing the ice grains received therein with the stored cooled water, and an ice slurry concentration adjusting section provided on the transfer passage for introducing the ice slurry from the ice slurry storage tank to the injection means at the upstream part.

9. An apparatus for surface processing using ice slurry according to claim 8, wherein the supercooled water production section includes a cooler for producing the supercooled water from cold water and a supercooled water relief means for relieving the supercooled state thereof, and a cold water temperature adjusting part is provided at the upstream of the cooler.

10. An apparatus for surface processing using ice slurry according to claim 8, wherein the concentration adjusting section is constituted so that the concentration is adjusted by supplying a proper amount of the cold water from the ice slurry storage tank to the high concentrated ice slurry drawn out from the ice slurry storage tank at the upstream part of the transfer passage.

11. An apparatus for surface processing using ice slurry according to claim 8, wherein the ice slurry storage tank is provided with circulation passage for returning the discharge water from the injection means in the surface processing section, to be used as the cold water.

12. An apparatus for surface processing using ice slurry according to claim 8, wherein the transfer passage is a double-piped one connecting the ice slurry storage tank with the injection means; the ice slurry being transferred in the inner pipe to the injection means by the fall (static head) or pressure feed, and the discharge water from the injection means being transferred in the outer pipe outside the inner pipe in the reverse direction.

13. An apparatus for surface processing using ice slurry according to claim 8, wherein the supercooled water relief means is an impact plate for producing the ice grains through the impinging of the falling supercooled water against the plate or an in-water relief means for producing the ice grains by the collision between solid particles or bubbles and the supercooled water.

* * * * *